United States Patent [19]

Gaelic

[11] Patent Number: 4,622,708

[45] Date of Patent: Nov. 18, 1986

[54] CLOTHES WASHING MACHINES

[75] Inventor: Christopher J. Gaelic, Mt. Wellington, New Zealand

[73] Assignee: Fisher & Paykel Limited, Aukland, New Zealand

[21] Appl. No.: 705,882

[22] Filed: Feb. 26, 1985

[30] Foreign Application Priority Data

Feb. 29, 1984 [NZ] New Zealand ..... 207323

[51] Int. Cl.[4] ..... D06F 13/02

[52] U.S. Cl. ..... 8/158; 8/159; 68/18 D; 68/23.7; 68/53; 68/134

[58] Field of Search ..... 8/158, 159; 68/18 D, 68/23.7, 53, 134

[56] References Cited

U.S. PATENT DOCUMENTS 2,976,711 3/1961 Smith ..... 68/53 X 4,077,239 3/1978 Platt et al. ..... 68/53

*Primary Examiner*—Philip R. Coe

*Attorney, Agent, or Firm*—Christie, Parker & Hale

[57] ABSTRACT

A clothes washing machine has a cabinet in which an agitator is mounted on a vertical axis and is oscillated back and forth within a perforated tub, the tub and the agitator rotating continuously in one direction to give a spin action and the perforated tub in turn being mounted within a watertight container in the cabinet, with a space between substantially vertical walls of said container, and a drain is provided to drain washing liquid from the container, there being circulating means operable during a washing cycle of the washing machine to cause washing liquid to circulate from the pool of washing liquid in which clothes are being washed through at least part of the space between said walls of the perforated tub and walls of said container and back to said pool of washing liquid through perforations in the perforated tub, the perforations being of a size and shape such and said circulation being such that any lint in the washing liquid tends to be left in the space for discharge therefrom during a draining cycle.

10 Claims, 2 Drawing Figures

CLOTHES WASHING MACHINES

FIELD OF THE INVENTION

This invention relates to clothes washing machines of the type in which an agitator is mounted on a vertical axis and is oscillated back and forth within a perforated tub, the tub and the agitator rotating continuously in one direction to give a spin action and the perforated tub in turn being mounted within a watertight container in a cabinet, and relates in particular to the reduction of lint in the washing liquid during the washing process.

SUMMARY OF THE INVENTION

It is therefore an object of the present invention to provide a clothes washing machine of the type described and/or method of controlling the same which will at least provide the public with a useful choice.

Accordingly in one aspect the invention consists in a method of controlling a clothes washing machine of the type having a cabinet in which an agitator is mounted on a vertical axis and is oscillated back and forth within a perforated tub, to give a washing action the tub and the agitator rotating continuously in one direction to give a spin action and the perforated tub in turn being mounted within a watertight container in said cabinet, with a space between substantially vertical walls of the perforated tub and adjacent walls of the container said method comprising the steps of causing circulation of washing liquid from the pool of washing liquid in which clothes are being washed through at least part of said space between said walls of said perforated tub and walls of said container and back to said pool of washing liquid through perforations of said perforated tub, said perforations being of a size and shape such that any lint in the washing liquid tends to be left in the space between said tub and said container for eventual discharge through a drain from said container, when said pool of washing liquid is being drained from said container by actuation of said draining means.

In a further aspect the invention consists in a clothes washing machine of the type having a cabinet in which an agitator is mounted on a vertical axis and is oscillated back and forth within a perforated tub, the tub and the agitator rotating continuously in one direction to give a spin action and the perforated tub in turn being mounted within a watertight container in said cabinet, with a space between substantially vertical walls of said container, draining means being provided to drain washing liquid from said container, said clothes washing machine including circulating means operable during a washing cycle of the washing machine to cause washing liquid to circulate from the pool of washing liquid in which clothes are being washed through at least part of said space between said walls of said perforated tub and walls of said container and back to said pool of washing liquid through perforations in said perforated tub, said perforations being of a size and shape such and said circulation being such that any lint in the washing liquid tends to be left in said space for discharge therefrom on actuation of said draining means with draining washing liquid.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention and modifications thereof will now be described with reference to the accompanying drawing in which.

DETAILED DESCRIPTION

Figure 1:
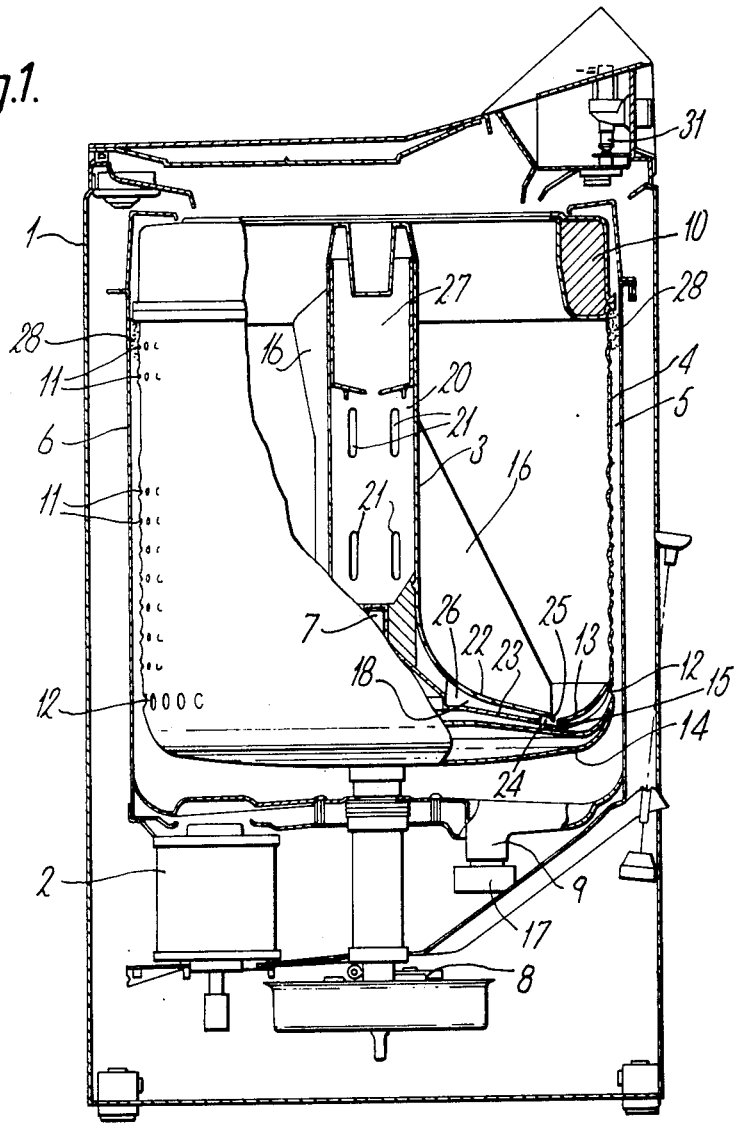
FIG. 1 is a diagrammatic cross section of a clothes washing machine constructed according to the invention and FIG. 2 is a block diagram of electronic connectors for effecting the invention.

Referring to the drawing, a clothes washing machine comprises a cabinet 1 which contains an electric motor 2 driving machinery which drives a shaft 7 in order to agitate an agitator 3 within a spin tub 4 which in turn is mounted with a clearance space 5 inside a watertight container 6. The drive mechanism preferably comprises the electric motor 2 directly connected or connected by pulleys and a belt (not shown) to the drive shaft 7 of the agitator and interconnecting means connect the drive shaft and the spin tub 4 so that when the drive shaft 7 is driven continuously in one direction the spin tub will be rotated to spin the clothes therein. The electric motor 2 is preferably electronically controlled to cyclically reverse to give the agitate action and on appropriately timed switching to change to continuous rotation to give the spin action. Brimer U.S. Pat. No. 3,914,963 discloses an agitator drive which when rotated continuously in one direction also drives the spin tub continuously in that direction. A drain exit 9 is provided in the container 6, the drain exit leading to a drain pump 17 in the usual way.

The spin tub 4 has a balancing ring 10 near the upper edge thereof and has a series of apertures 11 therein, the apertures 11 being so formed that the edges of the apertures are directed facing outwardly of the spin tub. These perforations are preferably round burst holes having a diameter of about 4 mm. A further series of apertures 12 are provided in a lower part of the spin tub and a shield or guide 13 is provided above the apertures 12, the apertures 12 being provided in the substantially vertical cylindrical wall of the spin tub above the base 14 of the spin tub.

The spin tub is preferably, though not necessarily a castellated drum as described in our U.S. Pat. No. 4,392,372. The agitator 3 has a hollow column 20 with a series of slots 21 positioned about midway of the length thereof and leading from the interior of the spin bowl 4 into the interior of the column 20. The agitator 3 has external blades 16 thereon which extend from the surface of both column 20 and the upper surface of an upper disc 22 (to be described below).

At the lower end the agitator extends outwardly in the form of an upper disc 22 and a lower disc 23 with a space 26 between them. This space may be divided with radial vanes 18 since the purpose of the two disc and space arrangement is to provide a centrifugal impeller. Such an impeller may be otherwise provided, and e.g. an independent centrifugal pump could be provided.

Outlet openings 24 are provided between the discs 22 and 23 at or near the outer edges of the discs and the outer edge 25 of the upper disc is turned downwardly and operates in close proximity to the inner edge of the guide 13.

The base 14 of the spin tub is castellated as above referred to, with spaces between the castellations and the spaces 15 between castellations provide passageways through which water is pumped as described below.

If desired a container 27 may be mounted on the column 20, such container holding a clothes conditioner in the known way.

The operation of the construction is as follows:

When the clothes washing machine has a load of clothes placed in it and the machine commenced to operate, washing liquid e.g. water, and detergent flows into the container 6 to form a pool to a desired level and the agitator 3 is set in motion to oscillate backwards and forwards. As a result of its motion there is a centrifugal pump action between the discs 22 and 24 assisted by vanes therein (if provided) and the centrifugal pumping action circulates the washing liquid, in which lint is usually entrained, into the hollow column 20 and downwardly and outwardly between the discs 22 and 24 for discharge through spacer 15 below the guide 13 and through the apertures 12 into the space 5 between the container 6 and the spin tub 4. The washing liquid is then drawn upwardly in space 5 between tub 4 and container 6 and then across the tub 4 to pass downwardly through the hollow column 20 and the process is repeated.

However re-entry of lint to the pool of washing liquid through the apertures 11 is limited, firstly by the size of these apertures, secondly, by the fact that the walls of the apertures are bulged outwardly, and thirdly because of the slower flow of fluid through the apertures 11 thus restricting the inflow of lint. As a result the lint collects in the space 5 and tends to either rise to the top as shown diagrammatically at 28 or settle into the bottom of the container depending on the nature of the lint.

Figure 2:
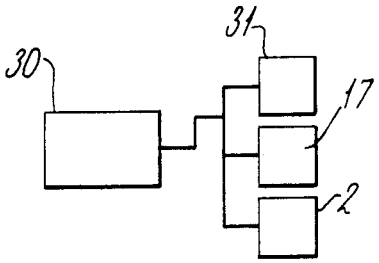

When the wash cycle is completed and a drain cycle is started, the drain outlet 9 is opened to allow flow of water through the drain and as a result of the draining action and also preferably because of rinse water entering the washing machine during a spray rinse cycle, which includes spinning the perforated tub at a suitable spin speed of rotation as part of the operation, the lint which is collected in the space 5 tends to be washed downwardly and outwardly through the drain outlet and pump. Thus the problem of lint collection is substantially overcome by the invention when performed at least in the preferred manner above described. To effect some spinning of the spin tub a microprocessor 30 (FIG. 2) instructs the motor 2 to rotate continuously while the pump 17 is driven at pumping speed. If rinsing is also effected a motor valve 31 is also operated to open.

What is claimed is:

1. A method of controlling a clothes washing machine of the type having a cabinet in which an agitator is mounted on a vertical axis and is oscillated back and forth within a perforated tub to give a washing action, the tub and the agitator rotating continuously in one direction to give a spin action and the perforated tub in turn being mounted within a watertight container in said cabinet, with a space between substantially vertical walls of the perforated tub and of the container, said method comprising the steps of causing circulation of washing liquid from a pool of washing liquid within the perforated tub in which clothes are being washed during oscillatory movement of the agitator, upwardly through at least part of said space and back to said pool of washing liquid through perforations formed in said perforated tub, said perforations being of a size and shape such that any lint in the washing liquid tends to be left in the space for eventual discharge through draining means from said container, when said pool of washing liquid is being drained from said container by actuation of said draining means.

2. A method as claimed in claim 1 which includes the steps of causing the lint to be removed from said space by causing said perforated tub to be rotated during the spin cycle of operation of the washing machine.

3. A method as claimed in claim 1 wherein said step of causing circulation of washing liquid is effected by drawing washing liquid from the pool of washing liquid in which clothes are being washed, downwardly through a passageway in the agitator, discharging such washing liquid outwardly into said space at a location between a lower part of said tub and of said container and causing the discharged washing liquid to pass upwards in said space and return to said pool through the perforations in said perforated tub.

4. A method as claimed in claim 1 which includes the step of actuating a centrifugal impeller by actuation of said agitator to cause said flow of washing liquid.

5. A clothes washing machine of the type having a cabinet, and mounted in the cabinet are a perforated tub having perforations therein, a watertight container and, an agitator, the agitator being mounted on a vertical axis and oscillated back and forth within the perforated tub, the tub and the agitator rotating continuously in one direction to give a spin action and the perforated tub in turn being mounted within the watertight container in said cabinet, said perforated tub and said container, comprising vertical walls forming a space there between said clothes washing machine further having draining means provided to drain washing liquid from said container, said clothes washing machine comprising circulating means operable during a washing cycle of the washing machine to cause a washing liquid to circulate from a pool of the washing liquid within the perforated tub in which clothes are being washed during oscillatory movement of the agitator, upwardly through at least part of said space and then back to said pool of washing liquid through perforations in said perforated tub, said perforations being of a size and shape such that and said circulation being such that any lint in the washing liquid tends to be left in said space for discharge from the space during a draining of liquid from the container through said draining means.

6. A clothes washing machine as claimed in claim 5 wherein control means are provided to cause spinning of said perforated tub during at least part of the draining cycle.

7. A clothes washing machine as claimed in claim 6 wherein said agitator has a hollow central column with liquid inlets intermediate of the length thereof and a pair of outwardly extending disc members adjacent a lower end of the agitator with an outer edge on each disc member and with a space between the disc members communicating with the hollow interior of said column and havig outlets at or near the outer edges of the disc members so that in use during the oscillatory movement of the agitator, the washing liquid is drawn into said hollow central column by centrifugal pump action between said lower discs and such washing liquid is discharged outwardly from the outer edges of said discs and is passed to said space.

8. A clothes washing machine as claimed in claim 7 wherein the perforated tub comprises a lower surface and a shield, perforations in said perforated tub being located between at least a portion of said shield and the lower surface of said perforated tub, said shield being provided between the edges of said discs and the substantially vertical wall of said perforated tub to guide water below said shield and above the lower surface of said perforated tub to the perforations in said perforated tub which are lower than at least a portion of said shield and above the lower surface of said perforated tub.

9. A clothes washing machine as claimed in claim 7 wherein said hollow column has inlet apertures about mid-way of the height of said column.

10. A clothes washing machine as claimed in claim 7 wherein said agitator has external blades thereon which extend from a surface of both said column and an upper surface of the uppermost one of said discs.

* * * * *